US009471022B2

(12) United States Patent
Mochizuki

(10) Patent No.: US 9,471,022 B2
(45) Date of Patent: Oct. 18, 2016

(54) PRINT CONTROL APPARATUS, PRINT CONTROL METHOD, IMAGE FORMING SYSTEM, AND NON-TRANSITORY COMPUTER READABLE MEDIUM

(71) Applicant: FUJI XEROX CO., LTD., Tokyo (JP)

(72) Inventor: Mamoru Mochizuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/811,983

(22) Filed: Jul. 29, 2015

(65) Prior Publication Data

US 2016/0266531 A1 Sep. 15, 2016

(30) Foreign Application Priority Data

Mar. 12, 2015 (JP) ..... 2015-049350

(51) Int. Cl.
*G03G 15/00* (2006.01)
*G03G 15/16* (2006.01)

(52) U.S. Cl.
CPC ..... *G03G 15/5087* (2013.01); *G03G 15/16* (2013.01)

(58) Field of Classification Search
USPC ..... 358/1.13, 1.14, 115, 1.16, 1.17
See application file for complete search history.

(56) References Cited

U.S. PATENT DOCUMENTS 6,914,692 B1 * 7/2005 Mitani ..... G06F 3/1213 358/1.15
8,634,107 B2 1/2014 Nakamura
2004/0239993 A1 * 12/2004 Urata ..... H04N 1/32358 358/1.16
2005/0116034 A1 * 6/2005 Satake ..... G06K 17/00 235/432
2010/0134844 A1 * 6/2010 Ito ..... G06K 15/02 358/1.17
2011/0242575 A1 * 10/2011 Owen ..... G03G 15/50 358/1.15
2012/0086970 A1 * 4/2012 Takahashi ..... G06K 15/1859 358/1.13
2012/0117459 A1 * 5/2012 DeHaven ..... G06F 17/30864 715/234
2014/0023383 A1 * 1/2014 Kogusuri ..... G03G 15/553 399/8
2015/0326745 A1 * 11/2015 Dong ..... H04N 1/00204 358/1.15

FOREIGN PATENT DOCUMENTS

JP 2013-67144 A 4/2013
JP 2013-205898 A 10/2013
JP 2014-52839 A 3/2014

* cited by examiner

*Primary Examiner* — Jerome Grant, II
(74) *Attorney, Agent, or Firm* — Sughrue Mion, PLLC

(57) ABSTRACT

A print control apparatus includes a generation unit, a storage unit, a transfer unit, a memory, and a controller. The generation unit generates image data by performing a rendering process in accordance with a print instruction. The storage unit stores the image data. The transfer unit reads the stored image data and transfers the read image data to a printer that performs printing on a sheet of paper. The memory stores, for each page in the print instruction, a processing time in association with the print instruction. In response to acceptance of an instruction for reprinting the print instruction, the controller controls whether to store the generated image data in the storage unit or to transmit the generated image data to the transfer unit, based on the processing time for each page stored in the memory in association with the print instruction.

10 Claims, 13 Drawing Sheets

PRINT CONTROL APPARATUS, PRINT CONTROL METHOD, IMAGE FORMING SYSTEM, AND NON-TRANSITORY COMPUTER READABLE MEDIUM

CROSS-REFERENCE TO RELATED APPLICATIONS

This application is based on and claims priority under 35 USC 119 from Japanese Patent Application No. 2015-049350 filed Mar. 12, 2015.

BACKGROUND (i) Technical Field

The present invention relates to a print control apparatus, a print control method, an image forming system, and a non-transitory computer readable medium.

(ii) Related Art

In a printer for printing on a continuous sheet of paper, in some cases, image data of all pages related to a print instruction may be rasterized and stored in a memory before printing is started, in order to prevent the occurrence of intermittent printing in which a blank page is inserted at an unintended position due to the presence of a delay in the processing for generating and transferring image data with respect to the printing speed of the printer.

SUMMARY

According to an aspect of the invention, there is provided a print control apparatus including a generation unit, a storage unit, a transfer unit, a memory, and a controller. The generation unit generates image data by performing a rendering process in accordance with a print instruction. The storage unit stores the image data. The transfer unit reads the image data stored in the storage unit and transfers the read image data to a printer that performs printing on a sheet of paper. The memory stores, for each page in the print instruction, a processing time in association with the print instruction. The processing time is a sum of a time from when the generation unit starts the rendering process to when the generation unit stores the image data in the storage unit and a time from when the transfer unit reads the image data from the storage unit to when the transfer unit transfers the read image data to the printer. In response to acceptance of an instruction for reprinting the print instruction, the controller controls whether to store the image data generated by the generation unit in the storage unit or to transmit the image data generated by the generation unit to the transfer unit, based on the processing time for each page stored in the memory in association with the print instruction.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail with reference to the drawings.

First Exemplary Embodiment

Figure 1:
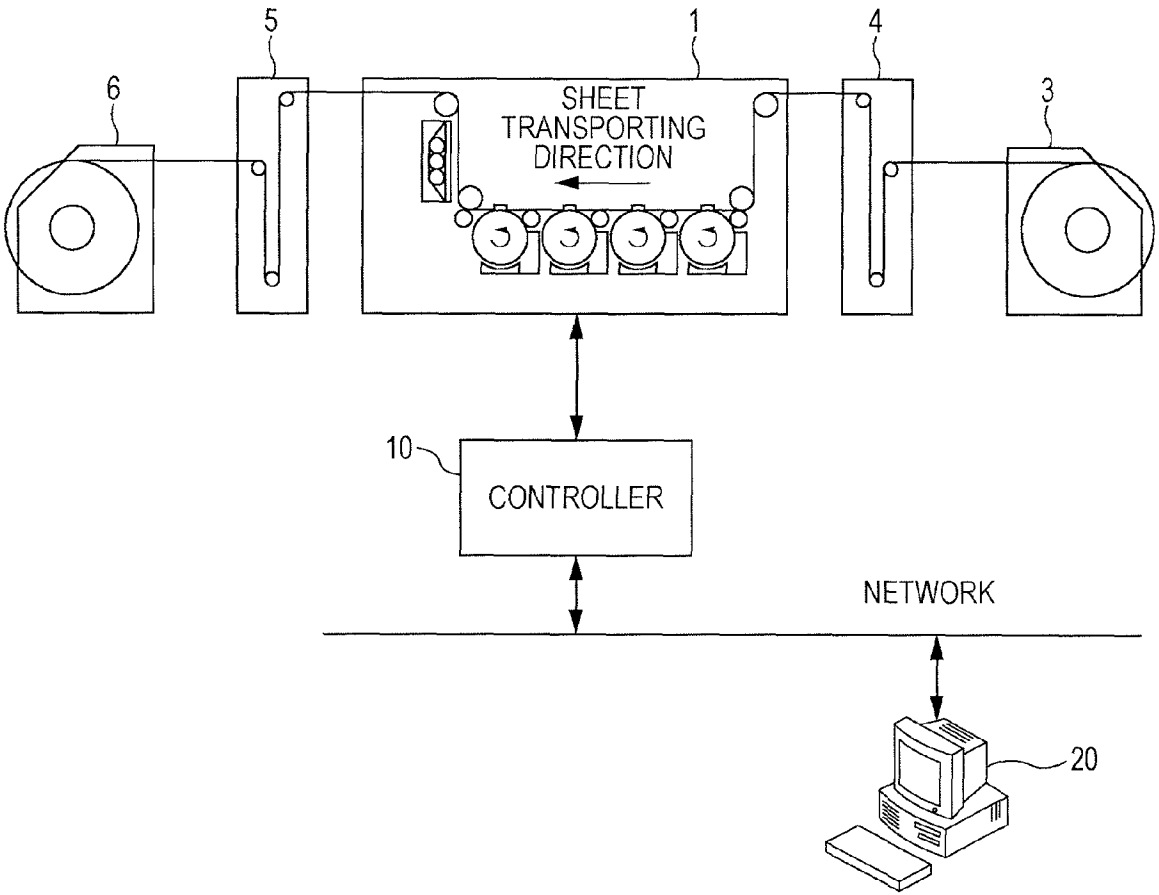
FIG. 1 is a diagram illustrating an example configuration of an image forming system according to a first exemplary embodiment of the present invention.

FIG. 1 is a diagram illustrating an example configuration of an image forming system according to a first exemplary embodiment of the present invention. The image forming system according to the first exemplary embodiment of the present invention includes a printer 1, a pre-processing device 3, a buffer device 4, a buffer device 5, a post-processing device 6, a controller 10, and a terminal apparatus 20. The controller 10 is connected to the terminal apparatus 20 so as to be capable of communicating with the terminal apparatus 20 via wired or wireless connection.

The printer 1 is controlled by the controller 10 to print image data on a continuous sheet of print paper such as a roll of paper.

The pre-processing device 3 performs pre-processing such as feeding an unprinted sheet of print paper. The post-processing device 6 performs post-processing such as rolling a printed sheet of print paper. The buffer devices 4 and 5 are arranged to maintain the tensions of a sheet of print paper between the pre-processing device 3 and the printer 1 and between the printer 1 and the post-processing device 6, respectively, for example.

The terminal apparatus 20 generates print data such as a print job and transmits the print data to the controller 10 via a network. The controller 10 serves as a print control apparatus for controlling the printing operation of the printer 1 in accordance with the print data transmitted from the terminal apparatus 20. The printer 1 outputs an image on a continuous sheet of paper in accordance with the print data under the control of the controller 10.

Figure 2:
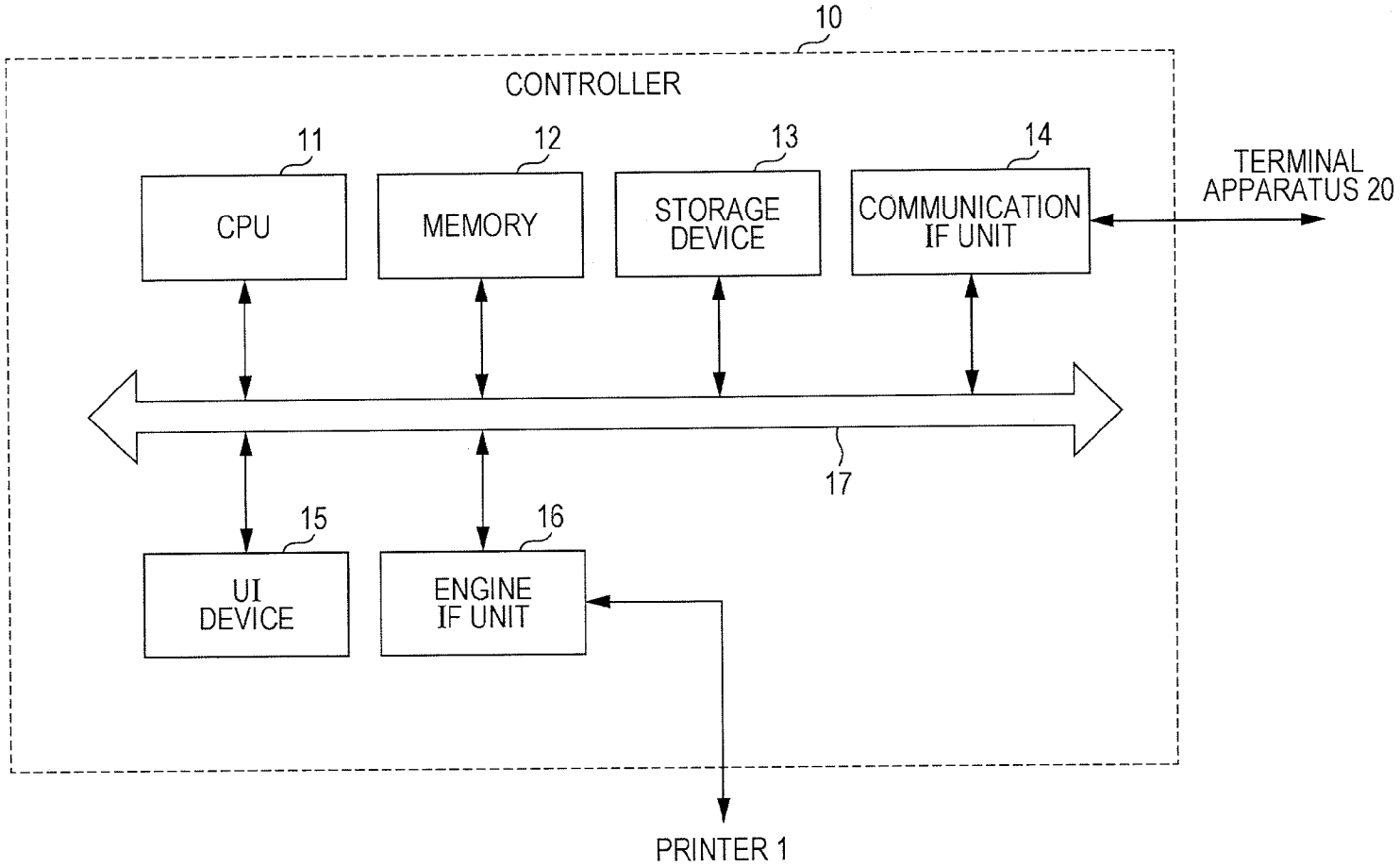
FIG. 2 is a block diagram illustrating a hardware configuration of a controller in the image forming system according to the first exemplary embodiment.

A hardware configuration of the controller 10 in the image forming system according to this exemplary embodiment will now be described with reference to FIG. 2. As illustrated in FIG. 2, the controller 10 according to this exemplary embodiment includes a central processing unit (CPU) 11, a memory 12, a storage device 13 such as a hard disk drive (HDD), a communication interface (IF) unit 14 that transmits and receives data to and from the terminal apparatus 20 via the network, a user interface (UI) device 15 formed of a touch panel or a liquid crystal display, and an engine IF unit 16 that transmits and receives data to and from the printer 1. The components described above are connected to one another via a control bus 17.

The CPU 11 performs a predetermined process in accordance with a print control program stored in the memory 12 or the storage device 13 to control the operation of the controller 10.

Figure 3:
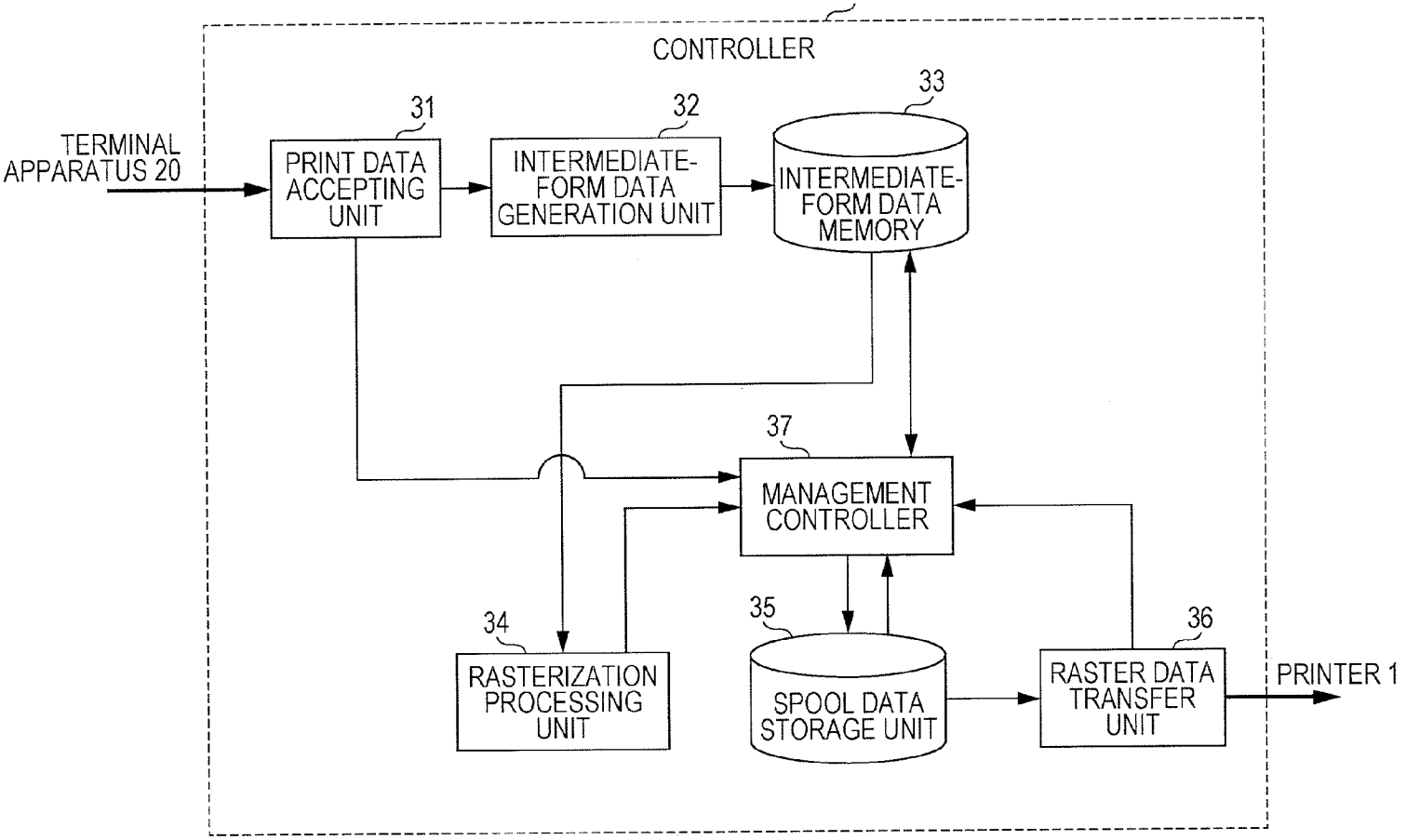
FIG. 3 is a block diagram illustrating a functional configuration of the controller in the image forming system according to the first exemplary embodiment.

FIG. 3 is a block diagram illustrating the configuration of the functions of the controller 10 which are implemented by the execution of the print control program.

As illustrated in FIG. 3, the controller 10 includes a print data accepting unit 31, an intermediate-form data generation unit 32, an intermediate-form data memory 33, a rasterization processing unit 34, a spool data storage unit 35, a raster data transfer unit 36, and a management controller 37.

The print data accepting unit 31 accepts print data (print instruction), which is generated by the terminal apparatus 20, via the network. The print data accepting unit 31 further accepts an instruction for reprinting the accepted print data from the terminal apparatus 20 via the network.

The intermediate-form data generation unit 32 generates data in an intermediate form (hereinafter referred to as the "intermediate-form data") in accordance with the print data accepted by the print data accepting unit 31.

The intermediate-form data memory 33 stores the intermediate-form data generated by the intermediate-form data generation unit 32.

The rasterization processing unit 34 performs a rasterization process (rendering process) based on the intermediate-form data to generate raster data (image data).

The spool data storage unit 35 stores the raster data generated by the rasterization processing unit 34.

The raster data transfer unit 36 reads the raster data stored in the spool data storage unit 35, and transfers the raster data to the printer 1.

The management controller 37 obtains a rasterization processing time and a reading time. The rasterization processing time is a time period from when the rasterization processing unit 34 starts a rasterization process to when the rasterization processing unit 34 completes the rasterization process. The reading time is a time period from when the raster data transfer unit 36 reads raster data from the spool data storage unit 35 to when the raster data transfer unit 36 transfers the read raster data to the printer 1. Further, the management controller 37 stores, for each page in the intermediate-form data of the print data, a processing time in the intermediate-form data memory 33 in association with the intermediate-form data. The processing time is a sum of the rasterization processing time and the reading time.

When the print data accepting unit 31 accepts an instruction for reprinting the print data, the management controller 37 controls whether to store the raster data in the spool data storage unit 35 or to transmit the raster data to the raster data transfer unit 36 on the basis of the processing time stored in the intermediate-form data memory 33 in association with the intermediate-form data.

In this exemplary embodiment, the management controller 37 determines whether or not the processing times for all pages in the intermediate-form data are each less than or equal to the time taken to print one page at the printing speed of the printer 1 (hereinafter referred to as the "page printing time"). The intermediate-form data memory 33 stores consecutive-printing availability information based on the determination result of the management controller 37 in association with the intermediate-form data. The consecutive-printing availability information indicates that consecutive printing is available in a case where the processing times for all the pages in the intermediate-form data are each less than or equal to the page printing time, and indicates that consecutive printing is unavailable in a case where the processing time for any of the pages in the print data exceeds the page printing time. Consecutive printing is a printing operation in which raster data is transferred to the printer 1 without delay with respect to the printing speed of the printer 1. When the print data accepting unit 31 accepts an instruction for reprinting the print data, the management controller 37 performs control to transmit the raster data to the raster data transfer unit 36 if the consecutive-printing availability information indicates that consecutive printing is available and performs control to store the raster data in the spool data storage unit 35 if the consecutive-printing availability information indicates that consecutive printing is unavailable. If the raster data is transmitted directly to the raster data transfer unit 36 without being stored in the spool data storage unit 35 when consecutive printing is unavailable, intermittent printing will occur. That is, a blank page will be inserted at the position corresponding to the page for which the raster data is transferred with delay with respect to the printing speed. To prevent such unexpected intermittent printing, particularly for initial printing, raster data of all pages related to a print instruction (print data) is stored in the spool data storage unit 35 and then transferred to the printer 1 via the raster data transfer unit 36.

Figure 4A:
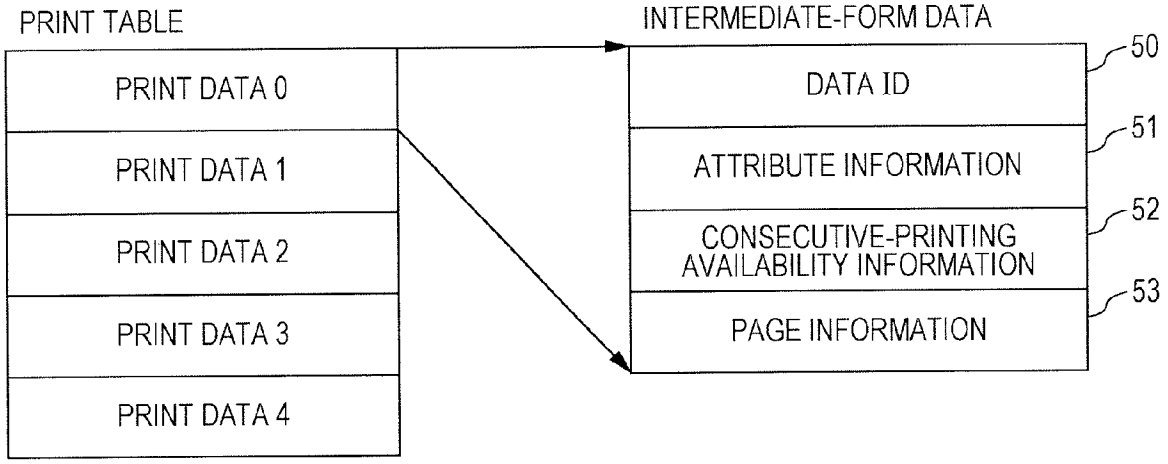
FIGS. 4A and 4B are diagrams illustrating an example of intermediate-form data stored in an intermediate-form data memory according to the first exemplary embodiment.
Figure 4B:
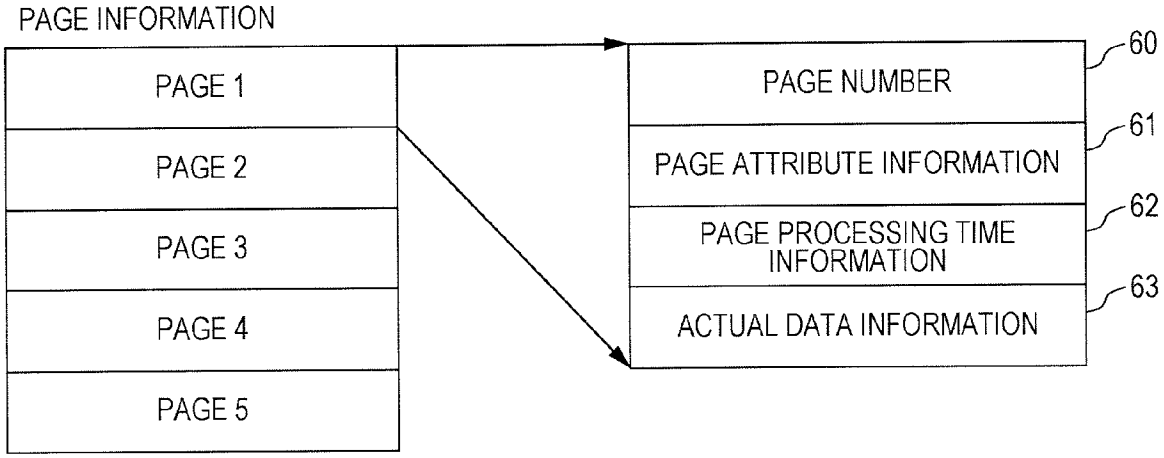

FIGS. 4A and 4B are diagrams illustrating an example of the intermediate-form data stored in the intermediate-form data memory 33 according to this exemplary embodiment.

As illustrated in FIG. 4A, the intermediate-form data memory 33 stores a print table in which pieces of print data accepted by the print data accepting unit 31 are sequentially arranged. The intermediate-form data memory 33 further stores, as intermediate-form data generated by the intermediate-form data generation unit 32 in accordance with each piece of print data, information which includes a data ID 50, attribute information 51 indicating the attribute of the piece of print data, consecutive-printing availability information 52, and page information 53 for reference to information on each page in the intermediate-form data.

The consecutive-printing availability information 52 is information used by the management controller 37 to determine whether to store the raster data generated by the rasterization processing unit 34 in the spool data storage unit 35 or to transmit the generated raster data to the raster data transfer unit 36. More specifically, the consecutive-printing availability information 52 indicates whether or not consecutive printing is available in which raster data is transferred to the printer 1 without the processing of each page being delayed with respect to the page printing time of the printer 1 even if the raster data is transferred to the raster data transfer unit 36 without being stored in the spool data storage unit 35. A specific method for setting the consecutive-printing availability information 52 will be described below.

As illustrated in FIG. 4B, the page information 53 includes, for each page, a page number 60, page attribute information 61 indicating the attribute of the page, page processing time information 62, and actual data information 63 concerning the actual data to be output to a continuous sheet of paper. The page processing time information 62 is information indicating the time taken for processing, which is calculated for each page by the management controller 37 as a sum of the rasterization processing time obtained from the rasterization processing unit 34 and the reading time obtained from the raster data transfer unit 36.

Next, a process performed by the controller 10 when print data is accepted from the terminal apparatus 20 (hereinafter referred to as "initial printing") according to this exemplary embodiment will be described in detail with reference to the drawings.

Figure 5:
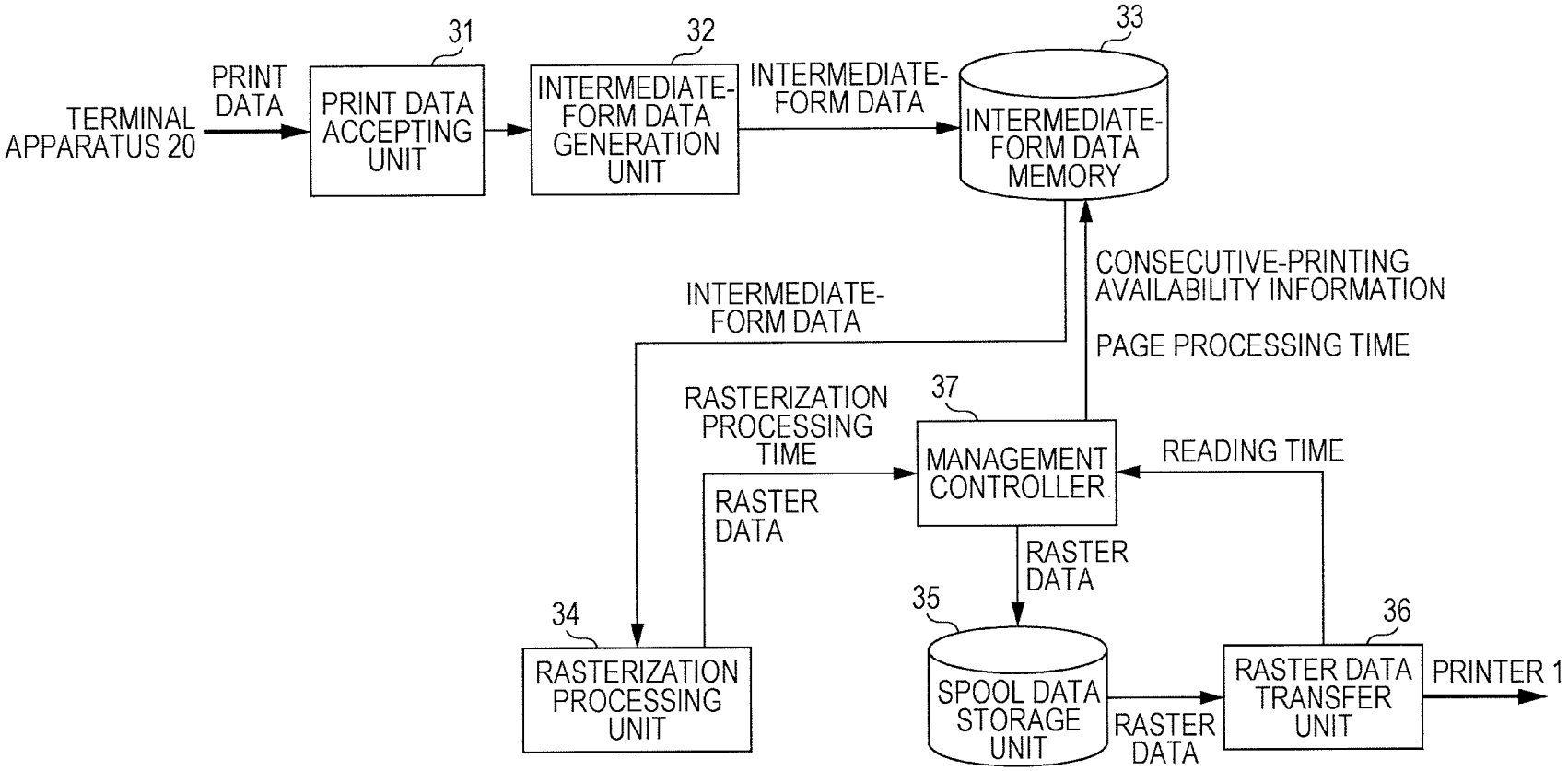
FIG. 5 is a schematic diagram illustrating a process for initial printing according to the first exemplary embodiment.

FIG. 5 is a schematic diagram illustrating a process for the initial printing according to this exemplary embodiment.

First, the intermediate-form data generation unit 32 generates intermediate-form data based on print data accepted by the print data accepting unit 31, and stores the intermediate-form data in the intermediate-form data memory 33.

Then, the rasterization processing unit 34 performs a rasterization process based on the intermediate-form data stored in the intermediate-form data memory 33 to generate raster data, and the management controller 37 performs control to store the raster data generated by the rasterization processing unit 34 in the spool data storage unit 35. In this case, the management controller 37 obtains, for each page in the intermediate-form data, a rasterization processing time from when the rasterization processing unit 34 starts a rasterization process based on the intermediate-form data to when the rasterization processing unit 34 stores raster data in the spool data storage unit 35.

The rasterization processing unit 34 performs the rasterization process until raster data of all the pages in the intermediate-form data is stored in the spool data storage unit 35.

When the rasterization processing unit 34 determines that the raster data of all the pages in the intermediate-form data has been stored in the spool data storage unit 35, the raster data transfer unit 36 reads the raster data stored in the spool data storage unit 35, and transfers the read raster data to the printer 1. In this case, the raster data transfer unit 36 notifies the management controller 37, on a page-by-page basis, of a reading time from when the raster data transfer unit 36 reads raster data from the spool data storage unit 35 to when the raster data transfer unit 36 transfers the read raster data to the printer 1.

Then, the management controller 37 calculates a sum of the obtained rasterization processing time and reading time to determine, for each page, the time taken to process the page (hereinafter referred to as the "page processing time"). The management controller 37 stores, for each page, the determined page processing time in the intermediate-form data memory 33 as the page processing time information 62 in association with the intermediate-form data. Further, the management controller 37 sets the consecutive-printing availability information 52 for the intermediate-form data by using a method described below in accordance with the page processing time information 62 on each page.

A specific method for setting the consecutive-printing availability information 52 according to this exemplary embodiment will now be described.

Figure 6:
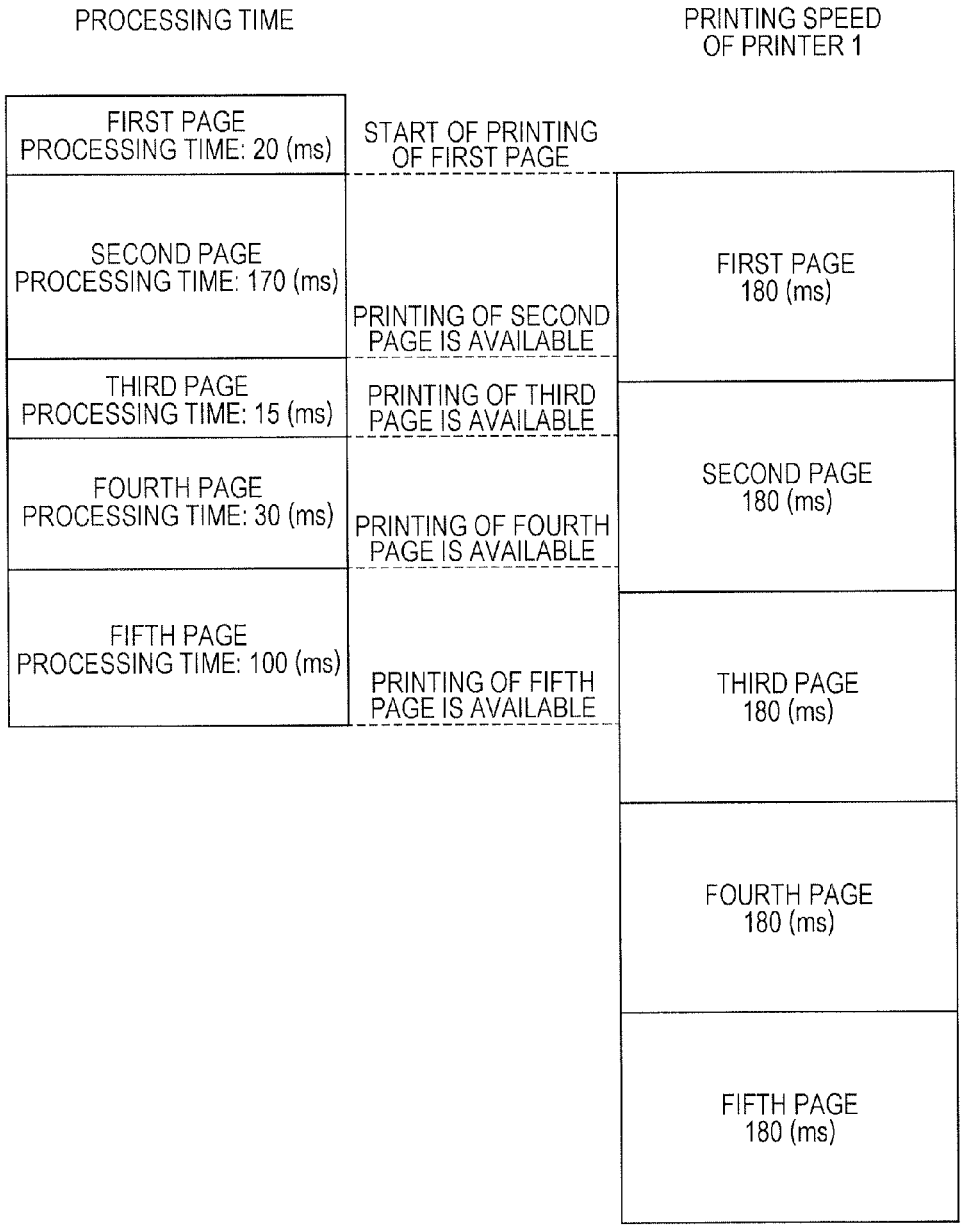
FIG. 6 is a diagram illustrating an example of comparison between a page processing time and the page printing time of a printer according to the first exemplary embodiment.
Figure 7:
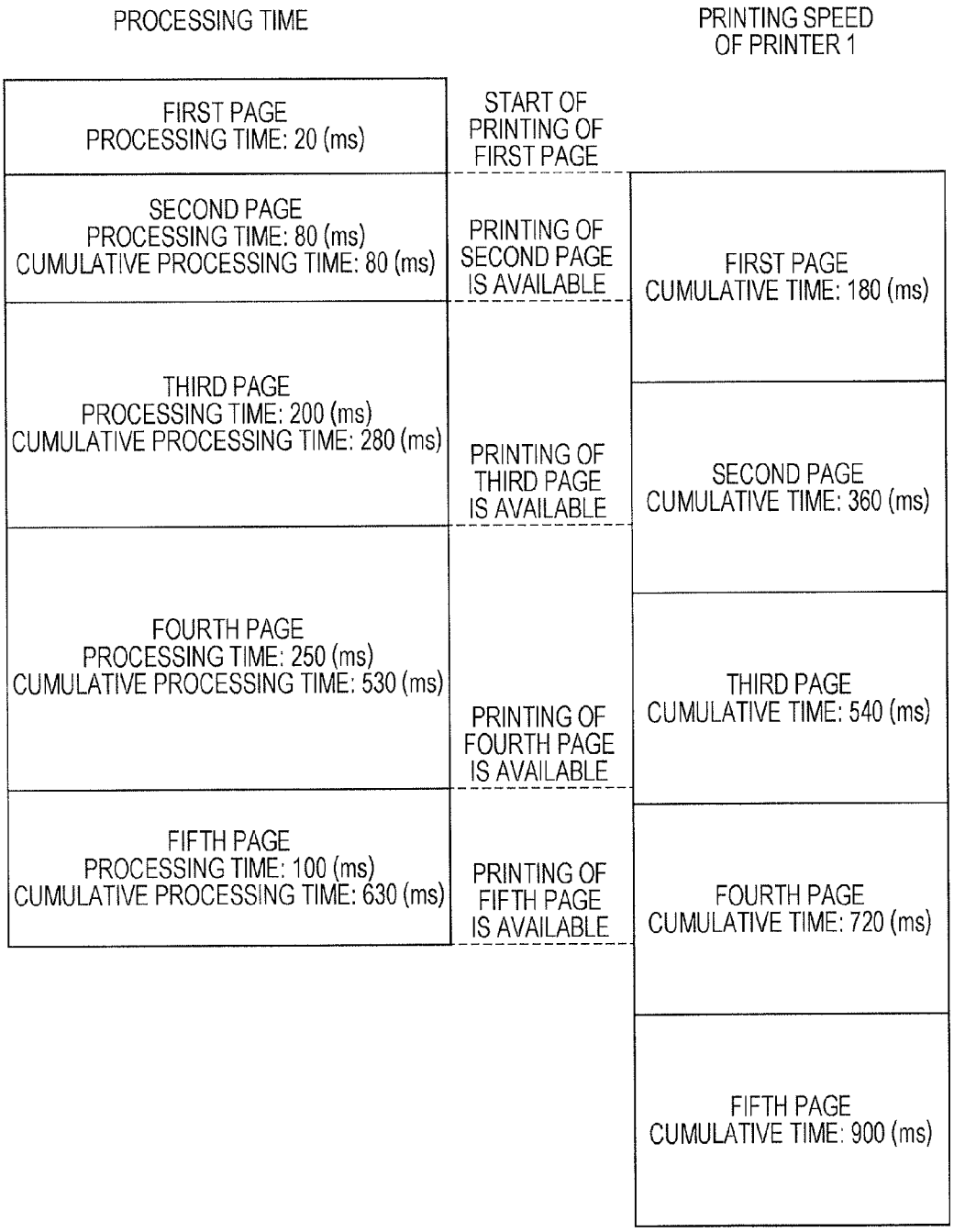
FIG. 7 is a diagram illustrating an example of comparison between a page processing time and the page printing time of the printer according to the first exemplary embodiment.

FIGS. 6 and 7 are diagrams illustrating examples of comparison between a page processing time and the time taken to print one page at the printing speed of the printer 1 (i.e., the page printing time of the printer 1) according to this exemplary embodiment.

As illustrated in FIG. 6, in this exemplary embodiment, the page printing time of the printer 1 is 180 ms, for example.

For example, as illustrated in FIG. 6, a description will be given in the context of print data of five pages in total, where the page processing time for the first page is 20 ms, the page processing time for the second page is 170 ms, the page processing time for the third page is 15 ms, the page processing time for the fourth page is 30 ms, and the page processing time for the fifth page is 100 ms.

First, the management controller 37 compares each of the page processing times with the page printing time and determines, on a page-by-page basis, whether or not the page processing time is less than or equal to the page printing time of the printer 1. If the page processing times for all the pages in the intermediate-form data are each less than or equal to the page printing time, the management controller 37 sets the consecutive-printing availability information 52 on the intermediate-form data to "available".

For example, in the example illustrated in FIG. 6, each of the page processing times for the first to fifth pages is shorter than 180 ms, which is the page printing time of the printer 1, and the page processing times for all the first to five pages are each less than or equal to the page printing time of the printer 1. As illustrated in FIG. 6, the printing of each of the first to fifth pages becomes available before the timing at which the printer 1 starts printing the page. This makes raster data of the respective pages in the intermediate-form data printable without delay with respect to the printing speed of the printer 1 even if the raster data is transmitted to the raster data transfer unit 36 without being stored in the spool data storage unit 35. Accordingly, the management controller 37 sets the consecutive-printing availability information 52 on the intermediate-form data to "available".

Instead of, or in addition to, comparing the page processing time for each page with the page printing time of the printer 1, the management controller 37 may compare a cumulative processing time which is a cumulative value of the page processing times with a cumulative value of the page printing times taken until the timing at which the printer 1 completes printing the respective pages.

Specifically, as illustrated in FIG. 7, a description will be given in the context of print data of five pages in total, where the cumulative processing time from the start of the printing of the first page until the printing of the second page becomes available is 80 ms, the cumulative processing time from the start of the printing of the first page until the printing of the third page becomes available is 280 ms, the cumulative processing time from the start of the printing of the first page until the printing of the fourth page becomes available is 530 ms, and the cumulative processing time from the start of the printing of the first page until the printing of the fifth page becomes available is 630 ms.

In the example illustrated in FIG. 7, while the page processing time for the third page, i.e., 200 ms, exceeds 180 ms, which is the page printing time of the printer 1, the cumulative processing time from when the printer 1 starts printing the first page until the printing of the third page becomes available is 280 ms, making the third page printable before the timing at which the printer 1 completes printing the second page, i.e., 360 ms. This makes raster data of the third page printable without delay with respect to the printing speed of the printer 1 even if the raster data is transferred to the printer 1 without being stored in the spool data storage unit 35. Also, the fourth page is printable before the timing at which the printer 1 completes printing the third page, i.e., 540 ms, although the page processing time for the fourth page, i.e., 250 ms, exceeds 180 ms, which is the page printing time of the printer 1. This makes raster data of the fourth page printable without delay with respect to the printing speed of the printer 1 even if the raster data is transferred to the printer 1 without being stored in the spool data storage unit 35.

In the case described above, even if raster data of a total of five pages is transferred to the raster data transfer unit 36 without being stored in the spool data storage unit 35 on a page-by-page basis, the raster data of the respective pages is printable without delay with respect to the printing speed of the printer 1. Accordingly, the management controller 37 sets the consecutive-printing availability information 52 on the intermediate-form data to "available".

Next, a process performed when the print data accepting unit 31 accepts an instruction for reprinting print data on which initial printing has been performed (a process for reprinting) according to this exemplary embodiment will be described in detail with reference to the drawings.

Figure 8:
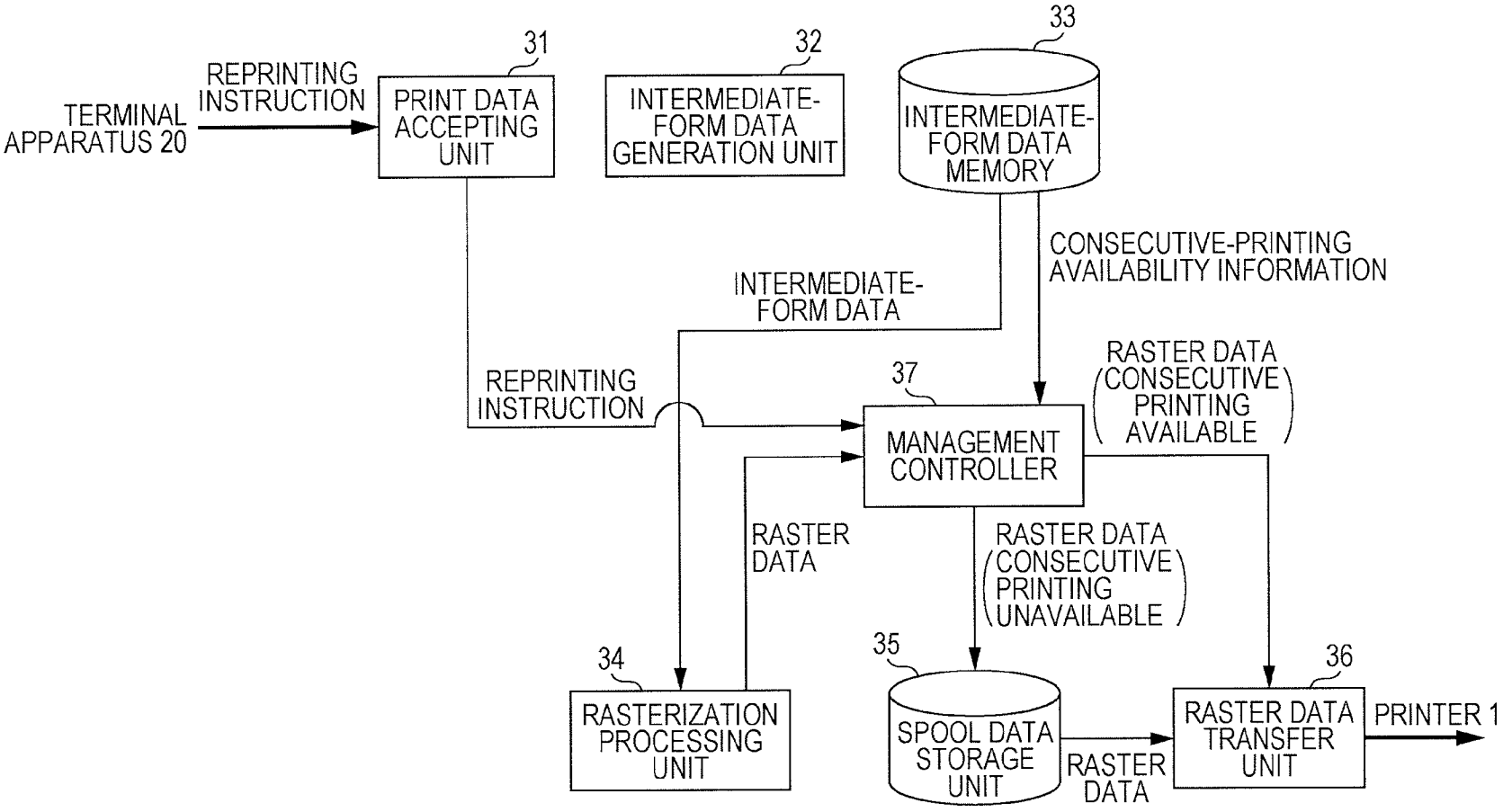
FIG. 8 is a conceptual diagram of a process for reprinting according to the first exemplary embodiment.

FIG. 8 is a schematic diagram illustrating a process for reprinting according to this exemplary embodiment.

As illustrated in FIG. 8, first, upon accepting a reprinting instruction from the terminal apparatus 20, the print data accepting unit 31 notifies the management controller 37 of the instruction.

Then, the management controller 37 refers to the intermediate-form data memory 33, and determines whether or not intermediate-form data specified in the accepted reprinting instruction has been stored in the intermediate-form data memory 33.

If the management controller 37 determines that the intermediate-form data specified in the accepted reprinting instruction has been stored in the intermediate-form data memory 33, the rasterization processing unit 34 obtains the intermediate-form data specified in the accepted reprinting instruction from the intermediate-form data memory 33, and performs a rasterization process based on the obtained intermediate-form data to generate raster data. In this case, the management controller 37 refers to the consecutive-printing availability information 52 stored in association with the intermediate-form data specified in the accepted reprinting instruction.

If the consecutive-printing availability information 52 indicates "unavailable", as in the initial printing, the management controller 37 performs control to store the raster data generated by the rasterization processing unit 34 in the spool data storage unit 35, so that raster data of all the pages in the intermediate-form data is stored in the spool data storage unit 35. Thereafter, the raster data transfer unit 36 transfers the raster data read from the spool data storage unit 35 to the printer 1.

If the consecutive-printing availability information 52 indicates "available", the management controller 37 performs control to transmit the raster data generated by the rasterization processing unit 34 to the raster data transfer unit 36 without storing the raster data in the spool data storage unit 35, and the raster data transfer unit 36 transfers the raster data transmitted from the management controller 37 to the printer 1. In this case, the printer 1 performs a printing process upon sequentially receiving raster data from the raster data transfer unit 36 without waiting for the rasterization processing unit 34 to complete the rasterization process of all the pages for reprinting, which reduces the time taken for reprinting compared to the time taken for initial printing.

In this exemplary embodiment, in the foregoing description, in response to acceptance of a reprinting instruction, the management controller 37 controls whether to store raster data generated by the rasterization processing unit 34 in the spool data storage unit 35 or to transmit the generated raster data to the raster data transfer unit 36 in accordance with consecutive-printing availability information 52 stored in association with intermediate-form data. Alternatively, a designated range of pages among the pages in print data may be specified in the accepted reprinting instruction. In this case, the management controller 37 may control whether to store raster data generated by the rasterization processing unit 34 in the spool data storage unit 35 or to transmit the generated raster data to the raster data transfer unit 36 in accordance with a page processing time associated with intermediate-form data of the print data.

For example, if a range of pages is specified in the accepted reprinting instruction, the management controller 37 refers to the intermediate-form data memory 33, and obtains page processing time information 62 stored in association with intermediate-form data specified in the accepted reprinting instruction. If the page processing times for all the pages within the specified range are each less than or equal to the page printing time of the printer 1, the management controller 37 may perform control to transmit raster data generated by the rasterization processing unit 34 to the raster data transfer unit 36 without storing the generated raster data in the spool data storage unit 35.

Figure 9:
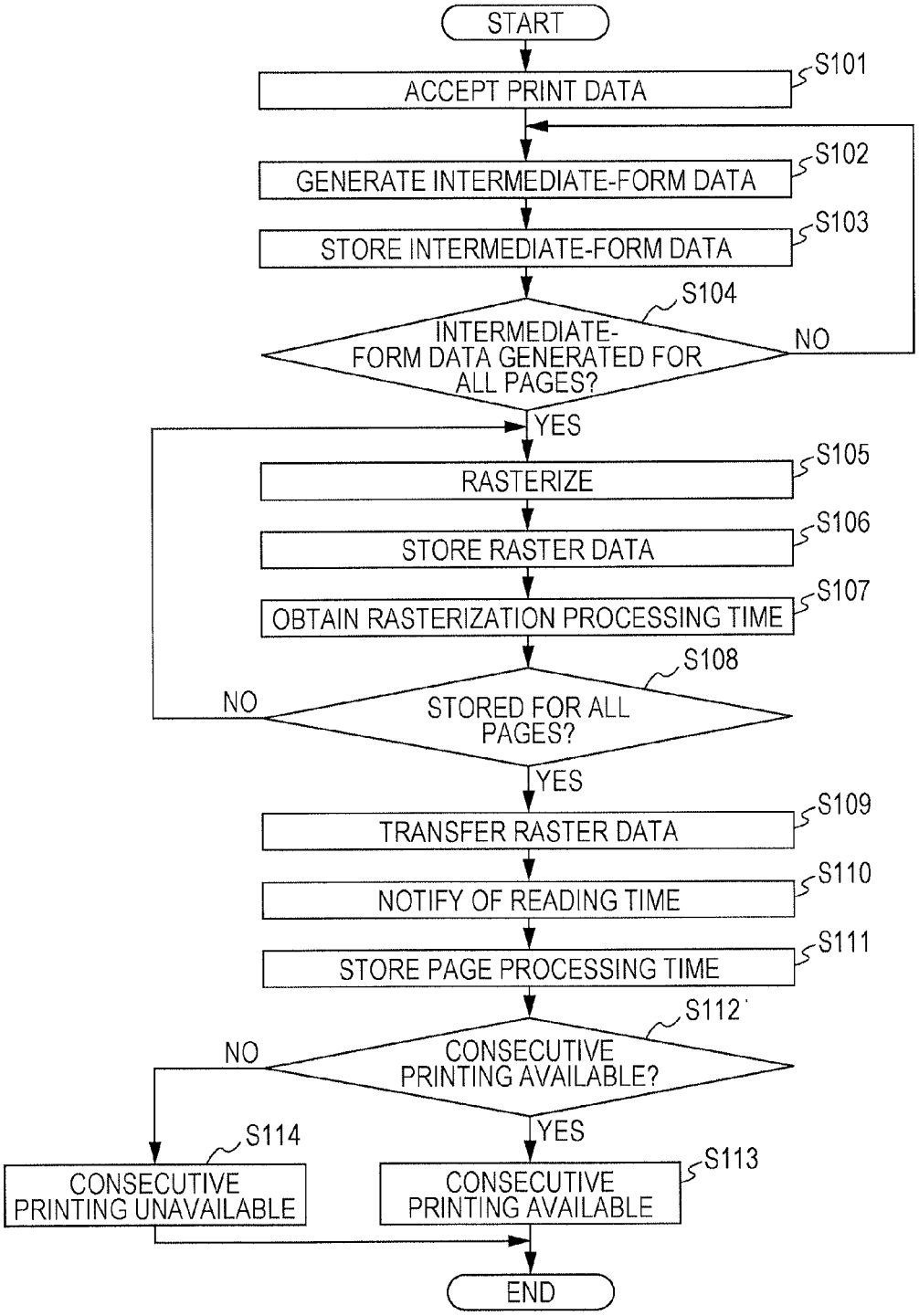
FIG. 9 is a flowchart illustrating a process performed by the controller for initial printing according to the first exemplary embodiment.
Figure 10:
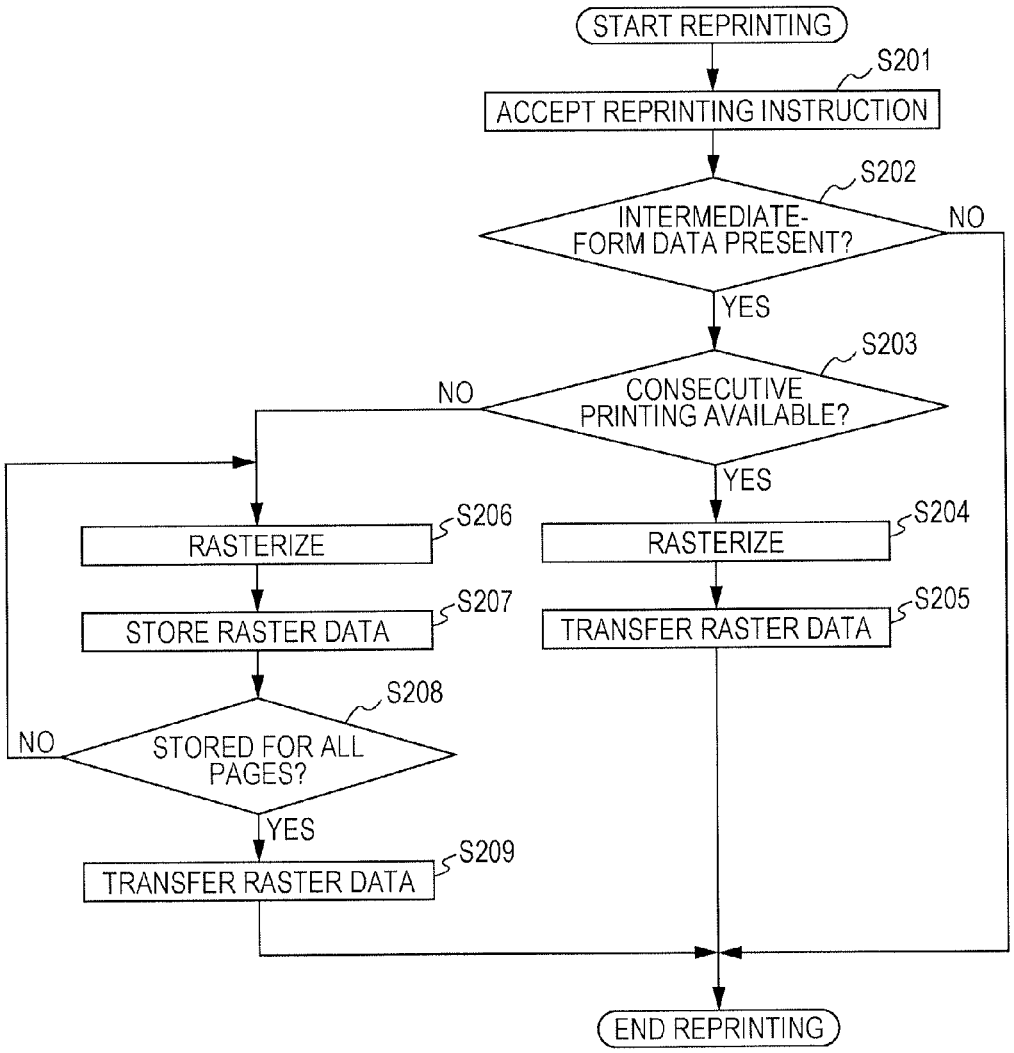
FIG. 10 is a flowchart illustrating a process performed by the controller for reprinting according to the first exemplary embodiment.

The process performed by the controller 10 according to this exemplary embodiment will be described with reference to flowcharts illustrated in FIGS. 9 and 10.

First, the process performed by the controller 10 for initial printing according to this exemplary embodiment will be described with reference to FIG. 9.

First, the print data accepting unit 31 accepts print data from the terminal apparatus 20 via the network (step S101).

Then, the intermediate-form data generation unit 32 generates intermediate-form data in accordance with the accepted print data (step S102).

Then, the intermediate-form data memory 33 stores the intermediate-form data generated by the intermediate-form data generation unit 32 (step S103).

Then, the intermediate-form data generation unit 32 determines whether or not intermediate-form data of all the pages in the accepted print data has been generated (step S104). If intermediate-form data of all the pages in the accepted print data has not been generated (NO in step S104), the process returns to step S102, and the processes after step S102 are repeatedly performed.

If intermediate-form data of all the pages in the accepted print data has been generated (YES in step S104), the rasterization processing unit 34 performs a rasterization process based on the intermediate-form data stored in the intermediate-form data memory 33 to generate raster data (step S105).

Then, the management controller 37 stores the raster data generated by the rasterization processing unit 34 in the spool data storage unit 35 (step S106), and obtains a rasterization processing time for each page (step S107).

Then, the rasterization processing unit 34 determines whether or not raster data of all the pages in the intermediate-form data has been stored in the spool data storage unit 35 (step S108). If the raster data of all the pages in the intermediate-form data has not been stored in the spool data storage unit 35 (NO in step S108), the process returns to step S105 and the processes after step S105 are repeatedly performed.

If the raster data of all the pages in the intermediate-form data has been stored in the spool data storage unit 35 (YES in step S108), the raster data transfer unit 36 reads the raster data stored in the spool data storage unit 35 and transfers the read raster data to the printer 1 (step S109). In this case, the raster data transfer unit 36 notifies the management controller 37, on a page-by-page basis, of a reading time from when the raster data transfer unit 36 reads the raster data from the spool data storage unit 35 to when the raster data transfer unit 36 transfers the read raster data to the printer 1 (step S110).

Then, the management controller 37 calculates a page processing time which is a sum of the obtained rasterization processing time and reading time, and stores the calculated page processing time for each page in association with the intermediate-form data stored in the intermediate-form data memory 33 (step S111).

Then, the management controller 37 determines, based on the page processing time for each page, which is stored in association with the intermediate-form data, whether or not consecutive printing is available (step S112).

If consecutive printing is available (YES in step S112), the management controller 37 sets the consecutive-printing availability information 52 on the intermediate-form data to "available" (step S113). If consecutive printing is unavailable (NO in step S112), the management controller 37 sets the consecutive-printing availability information 52 on the intermediate-form data to "unavailable" (step S114).

Next, the process performed by the controller 10 for reprinting according to this exemplary embodiment will be described with reference to FIG. 10.

First, the print data accepting unit 31 accepts a reprinting instruction for reprinting print data from the terminal apparatus 20 (step S201).

Then, the management controller 37 refers to the intermediate-form data memory 33, and determines whether or not intermediate-form data of the print data related to the accepted reprinting instruction is present (step S202). If the intermediate-form data of the print data related to the reprinting instruction is not present (NO in step S202), an error notification is sent via the terminal apparatus 20 or a display device (not illustrated) and then the process ends.

If the intermediate-form data of the print data related to the reprinting instruction is present (YES in step S202), the management controller 37 refers to the consecutive-printing availability information 52 included in the intermediate-form data of the print data related to the reprinting instruction, and determines whether the consecutive-printing availability information 52 indicates "available" or "unavailable" (step S203).

If the consecutive-printing availability information 52 indicates "available" (YES in step S203), the rasterization processing unit 34 performs a rasterization process based on the intermediate-form data to generate raster data (step S204). Then, the management controller 37 performs control to transmit the generated raster data to the raster data transfer unit 36 without storing the generated raster data in the spool data storage unit 35, and the raster data transfer unit 36 transfers the received raster data to the printer 1 (step S205).

If the consecutive-printing availability information 52 indicates "unavailable" (NO in step S203), the rasterization processing unit 34 performs a rasterization process based on the intermediate-form data to generate raster data (step S206), and the management controller 37 performs control to store the generated raster data in the spool data storage unit 35 (step S207). Then, the rasterization processing unit 34 determines whether or not raster data of all the pages in the intermediate-form data has been stored in the spool data storage unit 35 (step S208). If the raster data of all the pages in the intermediate-form data has not been stored in the spool data storage unit 35 (NO in step S208), the process returns to step S206 and the processes after step S206 are repeatedly performed.

If the raster data of all the pages in the intermediate-form data has been stored in the spool data storage unit 35 (YES in step S208), the raster data transfer unit 36 reads the raster data stored in the spool data storage unit 35 and transfers the read raster data to the printer 1 (step S209).

Second Exemplary Embodiment

A second exemplary embodiment of the present invention will now be described with reference to the drawings.

In the first exemplary embodiment described above, a description has been given of the case where an instruction for reprinting print data on which initial printing has been performed is provided. In the second exemplary embodiment, a description will be given of the case where print data accepted by the print data accepting unit 31 is print data created using a format (predetermined format) common to previously printed print data. A controller 10 according to this exemplary embodiment has a configuration similar to that in the first exemplary embodiment, and is not described herein.

Figure 11:
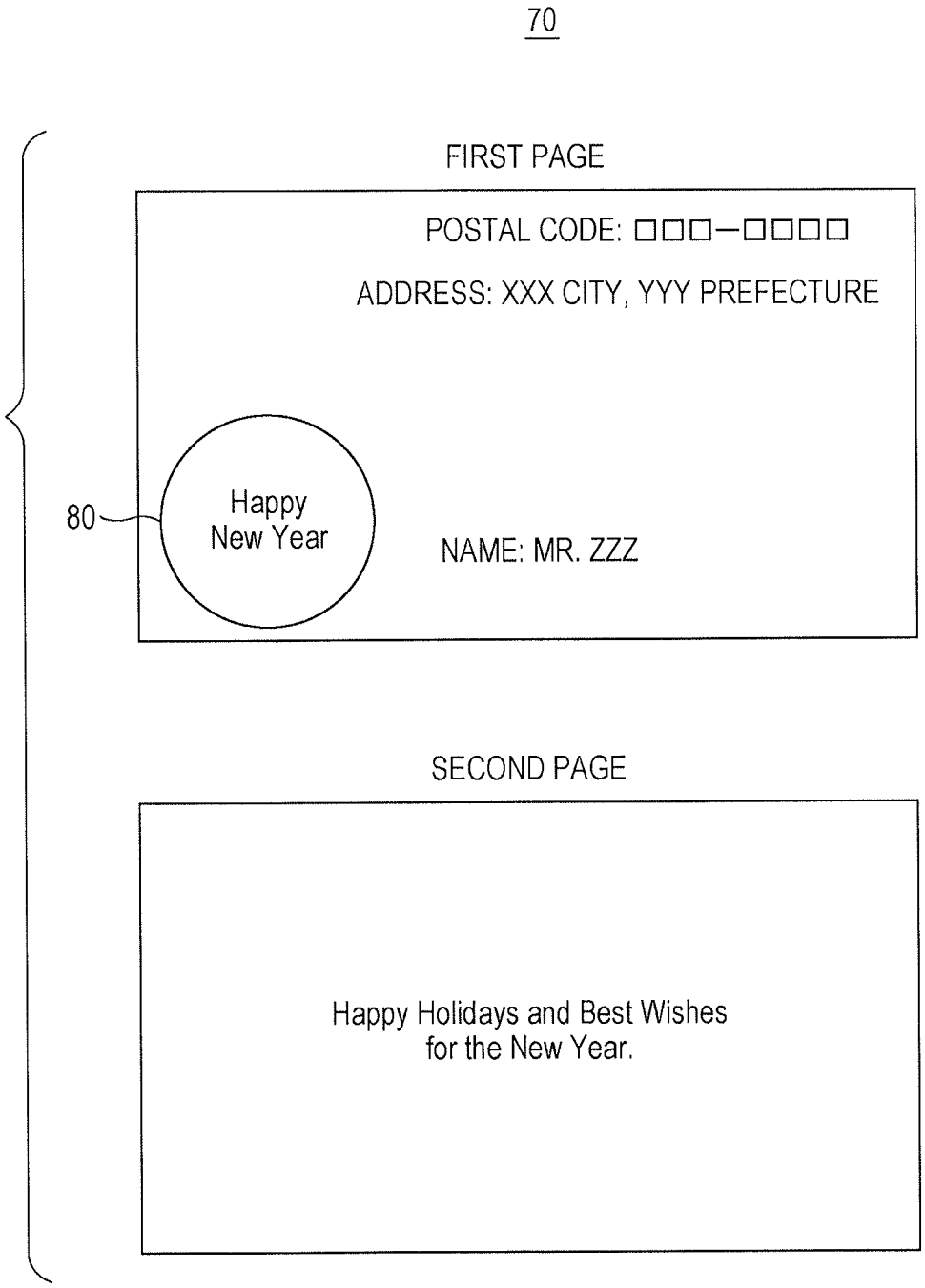
FIG. 11 is a diagram illustrating an example of a common format according to a second exemplary embodiment.

FIG. 11 is a diagram illustrating an example of a common format 70 according to this exemplary embodiment.

In this exemplary embodiment, the common format 70 is designed such that predetermined images are arranged at predetermined positions, and is used to create print data in which information on some of the images is modified. For example, in the example illustrated in FIG. 11, the positions of an object 80, a postal code, an address, and a name are determined in advance on the first page, and different pieces of information are output to the positions of the postal code, address, and name for each different piece of print data. In the common format 70, furthermore, as illustrated in FIG. 11, predetermined text is arranged on the second page.

In pieces of print data created using the common format 70, only part of information is different for each piece of print data. Thus, even different pieces of print data created using the common format 70 may be processed within substantially the same period of rasterization processing time.

Figure 12:
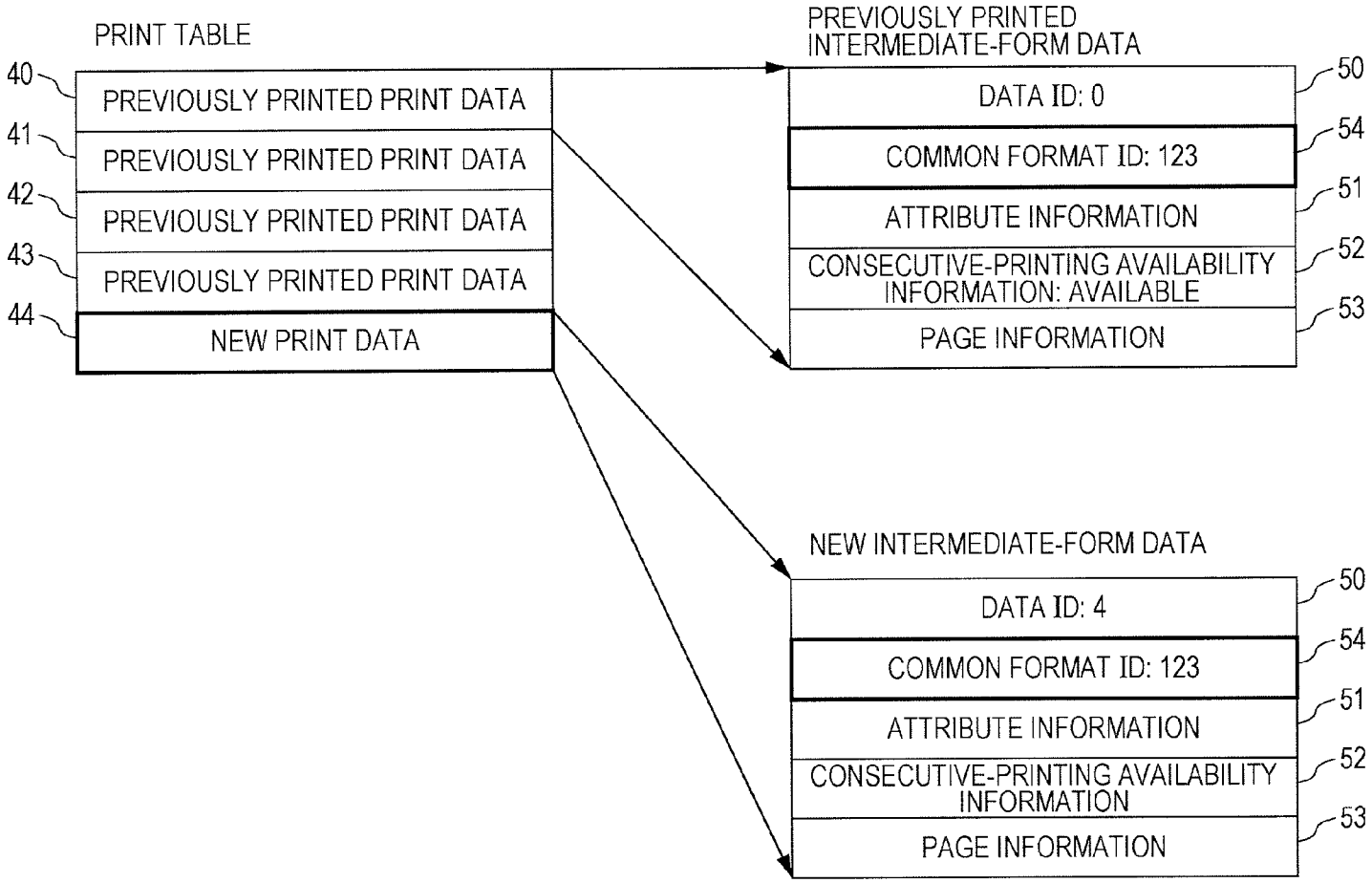
FIG. 12 is a diagram illustrating an example of intermediate-form data stored in the intermediate-form data memory according to the second exemplary embodiment.

FIG. 12 is a diagram illustrating an example of intermediate-form data stored in the intermediate-form data memory 33 according to this exemplary embodiment.

As illustrated in FIG. 12, in this exemplary embodiment, the intermediate-form data memory 33 stores a print table in which pieces of previously printed print data 40 to 43 on which initial printing has been performed are sequentially arranged, and printed intermediate-form data generated in accordance with each of the pieces of previously printed print data 40 to 43. When the print data accepting unit 31 accepts new print data 44, the intermediate-form data memory 33 adds the new print data 44 to the print table. The intermediate-form data memory 33 further stores new intermediate-form data generated by the intermediate-form data generation unit 32 in accordance with the new print data 44.

As illustrated in FIG. 12, intermediate-form data according to this exemplary embodiment further includes a common format ID 54 in addition to the data ID 50, the attribute information 51, the consecutive-printing availability information 52, and the page information 53.

In this exemplary embodiment, the common format ID 54 is information indicating a type of common format used to create the respective pieces of intermediate-form data. The common format ID 54 may be added by the terminal apparatus 20, or may be set in advance by the controller 10.

In a case where new intermediate-form data is created using the common format 70, the management controller 37 refers to the intermediate-form data memory 33 and determines whether or not intermediate-form data of previously printed print data which is created using the common format 70 has been stored in the intermediate-form data memory 33.

For example, if new intermediate-form data includes information "common format ID: 123", which indicates the common format 70, as the common format ID 54, the management controller 37 refers to the intermediate-form data memory 33 and determines whether or not the intermediate-form data of any of the pieces of previously printed print data 40 to 43 includes the information "common format ID: 123".

If the intermediate-form data of any of the pieces of previously printed print data 40 to 43 includes the information "common format ID: 123", the management controller 37 refers to the consecutive-printing availability information 52 stored in the intermediate-form data memory 33 in association with the intermediate-form data of the corresponding one of the pieces of previously printed print data 40 to 43. If the consecutive-printing availability information 52 indicates "available", the management controller 37 performs control to transmit raster data generated by the rasterization processing unit 34 in accordance with the new intermediate-form data to the raster data transfer unit 36.

For example, as illustrated in FIG. 12, in a case where the intermediate-form data of the previously printed print data 40 includes the information "common format ID: 123", the management controller 37 refers to the consecutive-printing availability information 52 stored in the intermediate-form data memory 33 in association with the intermediate-form data of the previously printed print data 40. Since the consecutive-printing availability information 52 stored in association with the intermediate-form data of the previously printed print data 40 indicates "available", the management controller 37 performs control to transmit raster data generated by the rasterization processing unit 34 in accordance with the new intermediate-form data to the raster data transfer unit 36.

Figure 13:
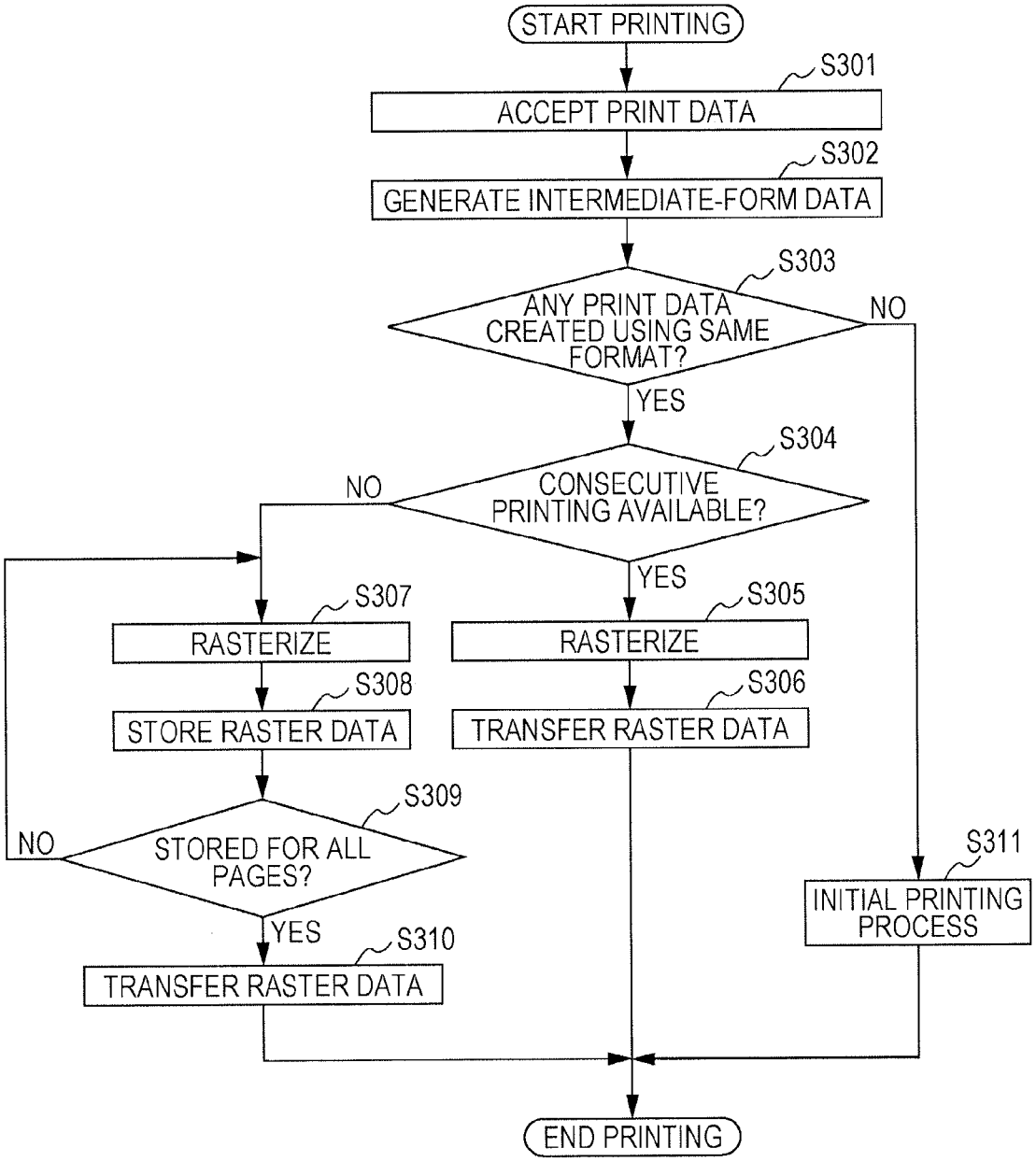
FIG. 13 is a flowchart illustrating a process performed by the controller according to the second exemplary embodiment.

A process performed by the controller 10 according to this exemplary embodiment will be described with reference to a flowchart illustrated in FIG. 13.

First, the print data accepting unit 31 accepts new print data 44 from the terminal apparatus 20 (step S301).

Then, the intermediate-form data generation unit 32 generates new intermediate-form data in accordance with the new print data 44 (step S302).

Then, the management controller 37 determines whether or not the intermediate-form data of previously printed print data created using the common format 70 which is identical to that of the new intermediate-form data is present (step S303).

If the intermediate-form data of previously printed print data created using the common format 70 which is identical to that of the new intermediate-form data is present (YES in step S303), the management controller 37 determines whether the consecutive-printing availability information 52 stored in the intermediate-form data memory 33 in association with the intermediate-form data of the previously printed print data indicates "available" or "unavailable" (step S304).

If the consecutive-printing availability information 52 indicates "available" (YES in step S304), the rasterization processing unit 34 performs a rasterization process based on the new intermediate-form data to generate raster data (step S305). Then, the management controller 37 transfers the generated raster data to the raster data transfer unit 36 without storing the raster data in the spool data storage unit 35 (step S306).

If the consecutive-printing availability information 52 indicates "unavailable" (NO in step S304), the rasterization processing unit 34 performs a rasterization process based on the new intermediate-form data to generate raster data (step S307), and the management controller 37 performs control to store the generated raster data in the spool data storage unit 35 (step S308). Then, the rasterization processing unit 34 determines whether or not raster data of all the pages in the new intermediate-form data has been stored in the spool data storage unit 35 (step S309). If the raster data of all the pages in the new intermediate-form data has not been stored in the spool data storage unit 35 (NO in step S309), the process returns to step S307 and the processes after step S307 are repeatedly performed.

If the raster data of all the pages in the new intermediate-form data has been stored in the spool data storage unit 35 (YES in step S309), the raster data transfer unit 36 reads the raster data stored in the spool data storage unit 35 and transfers the read raster data to the printer 1 (step S310).

If the intermediate-form data of previously printed print data created using the common format 70 which is identical to that of the new intermediate-form data is not present (NO in step S303), an initial printing process similar to that in the first exemplary embodiment is performed (step S311).

In the foregoing description, the printer 1 is configured to handle a continuous sheet of paper such as a roll of paper. In the exemplary embodiments of the present invention, the printer 1 may be configured to handle standard-size sheets, called cut sheets.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A print control apparatus comprising:

at least one processor configured to execute:

a generation unit configured to generate image data by performing a rendering process in accordance with a print instruction;

a storage unit configured to store the image data; and a transfer unit configured to read the image data stored in the storage unit and transfer the read image data to a printer that performs printing on a sheet of paper; and a memory configured to store, for each page in the print instruction, a processing time in association with the print instruction, the processing time being a sum of a time from when the generation unit starts the rendering process to when the generation unit stores the image data in the storage unit and a time from when the transfer unit reads the image data from the storage unit to when the transfer unit transfers the read image data to the printer; and wherein the at least one processor is further configured to execute a controller configured to, in response to acceptance of an instruction for reprinting the print instruction, control whether to store the image data generated by the generation unit in the storage unit or to transmit the image data generated by the generation unit to the transfer unit, based on the processing time for each page stored in the memory in association with the print instruction.

2. The print control apparatus according to claim 1, wherein the memory is configured to store consecutive-printing availability information in association with the print instruction, wherein the consecutive-printing availability information comprises information indicating that consecutive printing in which the image data is transferred to the printer without delay with respect to a printing speed of the printer is available in a case where the processing times for all pages in the print instruction are each less than or equal to a time taken to print one page at the printing speed of the printer, and indicating that the consecutive printing is unavailable in a case where the processing time for any of the pages in the print instruction exceeds the time taken to print one page at the printing speed of the printer, and wherein the controller is configured to, in response to acceptance of an instruction for reprinting the print instruction, perform control to transmit the image data to the transfer unit in a case where the consecutive-printing availability information indicates that the consecutive printing is available, and perform control to store the image data in the storage unit in a case where the consecutive-printing availability information indicates that the consecutive printing is unavailable.

3. The print control apparatus according to claim 1, wherein the at least one processor is further configured to execute an intermediate-form data generation unit configured to generate data in an intermediate form in accordance with the print instruction, wherein the generation unit is configured to perform the rendering process based on the data in the intermediate form, and wherein the memory is configured to store the data in the intermediate form generated by the intermediate-form data generation unit in association with the processing time for each page.

4. The print control apparatus according to claim 2, wherein the at least one processor is further continued to execute an intermediate-form data generation unit configured to generate data in an intermediate form in accordance with the print instruction, wherein the generation unit is configured to perform the rendering process based on the data in the intermediate form, and wherein the memory is configured to store the data in the intermediate form generated by the intermediate-form data generation unit in association with the processing time for each page.

5. A print control apparatus comprising:

at least one processor configured to execute:

a generation unit configured to generate image data by performing a rendering process in accordance with a print instruction;

a storage unit that configured to store to store the image data;

a transfer unit that configured to read the image data stored in the storage unit and transfer the read image data to a printer that performs printing on a sheet of paper; and a memory configured to store, for each page in the print instruction, a processing time in association with the print instruction, the processing time being a sum of a time from when the generation unit starts the rendering process to when the generation unit stores the image data in the storage unit and a time from when the transfer unit reads the image data from the storage unit to when the transfer unit transfers the read image data to the printer; and wherein the at least one processor is further configured to execute a controller configured to, in a case where the print instruction is created using a predetermined format and the memory has stored therein a previously printed print instruction created using a format which is identical to the predetermined format, control whether to store the image data in the storage unit or to transmit the image data to the transfer unit, based on a processing time for the previously printed print instruction, the processing time for the previously printed print instruction being stored in the memory in association with the previously printed print instruction.

6. The print control apparatus according to claim 5, wherein the at least one processor is further configured to execute an intermediate-form data generation unit configured to generate data in an intermediate form in accordance with the print instruction, wherein the generation unit is configured to perform the rendering process based on the data in the intermediate form, and wherein the memory is configured to store the data in the intermediate form generated by the intermediate-form data generation unit in association with the processing time for each page.

7. An image forming system comprising:

a printer that configured to perform printing on a sheet of paper;

at least one processor configured to execute:

a generation unit that configured to generate image data by performing a rendering process in accordance with a print instruction;

a storage unit configured to store the image data; and a transfer unit configured to read the image data stored in the storage unit and transfer the read image data to the printer; and a memory configured to store, for each page in the print instruction, a processing time in association with the print instruction, the processing time being a sum of a time from when the generation unit starts the rendering process to when the generation unit stores the image data in the storage unit and a time from when the transfer unit reads the image data from the storage unit to when the transfer unit transfers the read image data to the printer; and wherein the at least one processor is further configured to execute a controller configured to, in response to acceptance of an instruction for reprinting the print instruction, control whether to store the image data generated by the generation unit in the storage unit or to transmit the image data generated by the generation unit to the transfer unit, based on the processing time for each page stored in the memory in association with the print instruction.

8. An image forming system comprising:

a printer configured to perform printing on a sheet of paper;

at least one processor configured to execute:

a generation unit configured to generate image data by performing a rendering process in accordance with a print instruction;

a storage unit configured to store the image data;

a transfer unit configured to read the image data stored in the storage unit and transfer the read image data to the printer; and a memory configured to store, for each page in the print instruction, a processing time in association with the print instruction, the processing time being a sum of a time from when the generation unit starts the rendering process to when the generation unit stores the image data in the storage unit and a time from when the transfer unit reads the image data from the storage unit to when the transfer unit transfers the read image data to the printer; and wherein the at least one processor is further configured to execute a controller configured to, in response to the print instruction being created using a predetermined format and the memory having stored therein a previously printed print instruction created using a format which is identical to the predetermined format, control whether to store the image data in the storage unit or to transmit the image data to the transfer unit, based on a processing time for the previously printed print instruction, the processing time for the previously printed print instruction being stored in the memory in association with the previously printed print instruction.

9. A print control method comprising:

generating image data by performing a rendering process in accordance with a print instruction;

storing the image data;

reading the stored image data;

transferring the read image data to a printer;

storing, in a memory, for each page in the print instruction, a processing time in association with the print instruction, the processing time being a sum of a time from when the rendering process is started to when the image data is stored and a time from when the stored image data is read to when the read image data is transferred to the printer; and in response to acceptance of an instruction for reprinting the print instruction, controlling whether to store the generated image data or to transfer the generated image data to the printer, based on the processing time for each page stored in the memory in association with the print instruction.

10. A non-transitory computer readable medium storing instructions for causing at least one processor to execute a process comprising:

generating image data by performing a rendering process in accordance with a print instruction;

storing the image data;

reading the stored image data;

transferring the read image data to a printer;

storing, in a memory, for each page in the print instruction, a processing time in association with the print instruction, the processing time being a sum of a time from when the rendering process is started to when the image data is stored and a time from when the stored image data is read to when the read image data is transferred to the printer; and in response to acceptance of an instruction for reprinting the print instruction, controlling whether to store the generated image data or to transmit the generated image data to the printer, based on the processing time for each page stored in the memory in association with the print instruction.

* * * * *